United States Patent [19]

Farmont

[11] Patent Number: 4,488,389

[45] Date of Patent: Dec. 18, 1984

[54] SECURING MEANS FOR LOG CONSTRUCTION

[76] Inventor: Johann H. Farmont, 434 Golden Gate Ave., Belvedere, Calif. 94920

[21] Appl. No.: 451,416

[22] Filed: Dec. 20, 1982

[51] Int. Cl.[3] ..... E04B 1/10; E04B 1/38; F16B 1/00

[52] U.S. Cl. ..... 52/233; 52/715; 52/DIG. 6; 403/283; 403/405; 411/458; 411/466

[58] Field of Search ..... 52/233, 583, DIG. 6, 52/715, 256, 257, 458; 403/283, 285, 405, 406; 411/466, 467, 468, 462, 461

[56] References Cited

U.S. PATENT DOCUMENTS

| | | | |
|---|---|---|---|
| 1,426,232 | 8/1922 | Theodorsen | 403/283 |
| 2,101,378 | 12/1937 | Wiskoff | 52/DIG. 6 |
| 2,316,819 | 4/1943 | Tedrow | 52/583 |
| 3,214,802 | 11/1965 | Davis | 411/466 |
| 3,276,797 | 10/1966 | Humes, Jr. | 52/715 |
| 3,305,252 | 2/1967 | Jureit | 403/406 |
| 3,460,301 | 8/1969 | Davis | 52/233 |
| 3,841,195 | 10/1974 | Jureit | 52/715 |
| 4,299,511 | 11/1981 | Demers | 403/283 |

FOREIGN PATENT DOCUMENTS

| | | | |
|---|---|---|---|
| 399326 | 7/1920 | Fed. Rep. of Germany | 52/233 |
| 6715491 | 5/1968 | Netherlands | 52/582 |
| 438658 | 12/1967 | Switzerland | 52/233 |

*Primary Examiner*—Donald G. Kelly
*Assistant Examiner*—Michael Safavi
*Attorney, Agent, or Firm*—Melvin R. Stidham

[57] ABSTRACT

A building wall comprising the plurality of stacked logs with flat top and bottom surfaces into each of which is cut a deep slot. A metal bar is received in the aligned slots of vertically adjacent logs and pointed projections penetrate into the wood of the logs to prevent separation. In one embodiment, the projections are spaced clusters of downwardly extending nails which prevent separation of logs placed end to end and upwardly extending nails which prevent shear movement of adjacent logs. In another embodiment, the bar has sharp projections which are punched from the surface thereof to be received in the aligned slots of adjacent logs and penetrate a side wall of said slot.

8 Claims, 5 Drawing Figures

SECURING MEANS FOR LOG CONSTRUCTION

BACKGROUND OF THE INVENTION

There are many advantages in the use of logs in building construction. For example, the thick timbers provide excellent thermal insulation and are resistant to combustion. Further, in log structures, the thick timbers are generally interlocked at wall junctions and provide an extremely rigid structure, highly resistant to storms, earthquakes and the like. Still, many building codes require at least minimal use of nails or other fastening means to secure the logs together. Driving long nails through finished logs or timbers, which may be as much as 6 inches thick can be very difficult and time consuming, resulting in excessive labor costs for an operation that is of little or no real benefit.

OBJECTS OF THE INVENTION

It is an object of this invention to provide a fastening member for log structures that is easy to apply and yet will meet the requirements of building codes.

It is a further object of this invention to provide a log joiner that will secure the logs firmly against separation as well as shear.

It is a further object of this invention to provide a log structure wherein logs are easily fit together and secured by mutually engagable fastening members.

It is a further object of this invention to provide a fastening member for a log wall that serves also as a guide in placement of logs.

Other objects and advantages of this invention will become apparent from the description to follow, particularly when read in conjunction with the accompanying drawings.

SUMMARY OF THE INVENTION

In carrying out this invention, a log structure is formed of finished logs having relatively flat top and bottom surfaces, though with interengaging tongues and grooves. A deep slot is provided in both top and bottom surfaces. A connector plate having spaced clusters of downwardly depending, nail-like sharp projections, and an intermediate cluster of similar, but upwardly extending projections is driven to penetrate the opposing surfaces of vertically adjacent logs. A vertical metal bar between the downward projections is received in the slot in the top of a lower log, while similar bars extending upward from the plate overlying the downward clusters, receive the slot of the log supported thereon. The spaced clusters of downwardly depending nails may be driven into logs disposed end to end to prevent longitudinal separation thereof.

In another embodiment, a steel bar having pointed, toothlike projections punched from the surface thereof is driven into a slot of one log to engage in the sides of the slot and the next log is placed down over it so that additional sharp projections engage the sides of the slot in its bottom surface.

DESCRIPTION OF PREFERRED EMBODIMENTS

Figure 2:
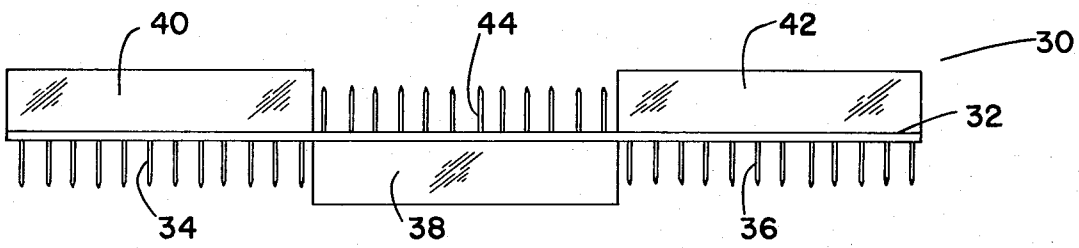
FIG. 2 is an elevation view of the log joiner embodiment of FIG. 1.
Figure 1:
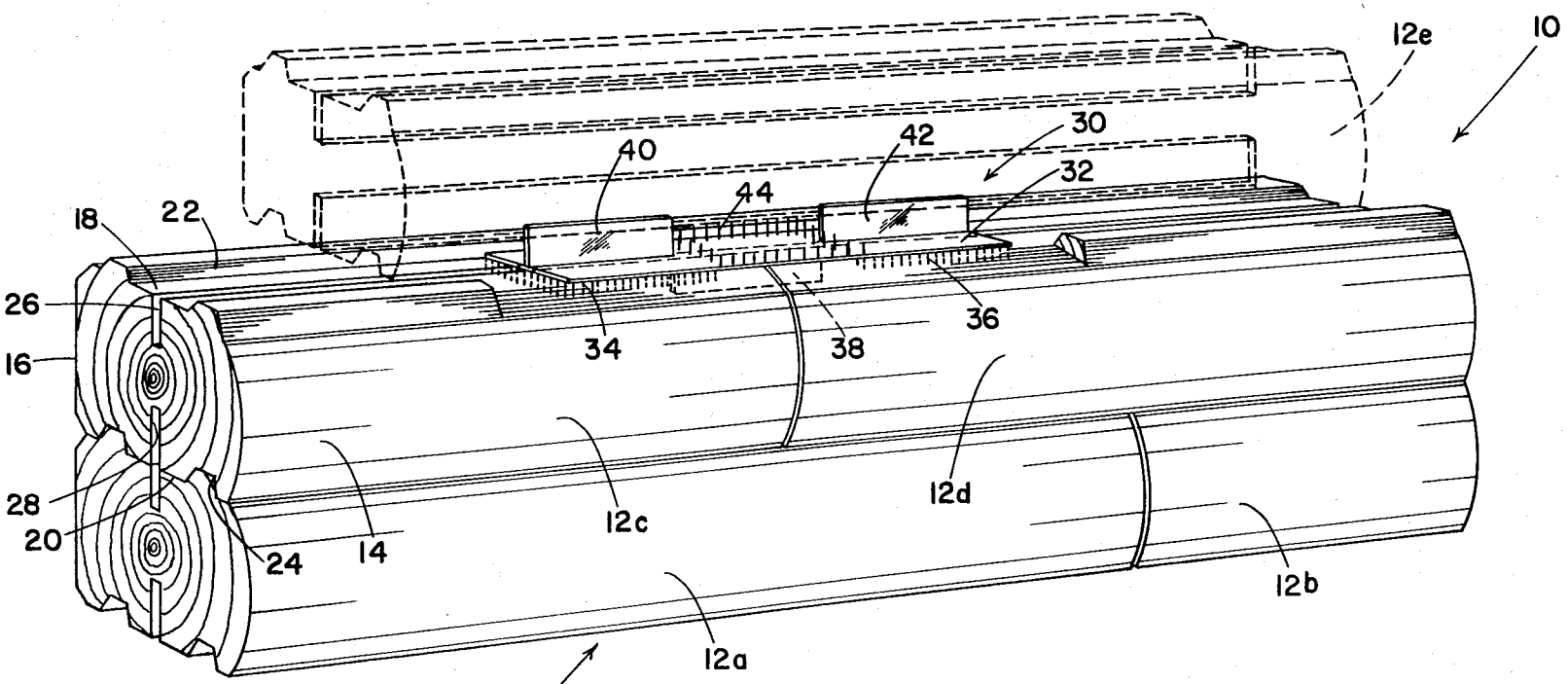
FIG. 1 is a partial view in perspective of a log wall including one embodiment of a log joiner.

The Embodiment of FIGS. 1 and 2

Referring now to FIG. 1 with greater particularity, the log structure 10 of this invention includes a plurality of heavy timbers 12*a*, 12*b*, 12*c*, 12*d* and 12*e*, which are stacked one on top of the other. The logs 12*a* . . . 12*e* are generally square in cross section although they may have a curved front face 14 to more nearly resemble a hewn log. The rear face 16 may be curved or flat as shown and the top and bottom surfaces 18 and 20 are generally planar, though with complementary pairs of tongues 22 and grooves 24, whereby vertically adjacent logs, e.g. 12*a* and 12*c* are nested together and firmly interlocked. Cut into the top and bottom surfaces 18 and 20 are deep slots 26 and 28 which absorb a certain amount of circumferential expansion and contraction of the logs without producing the customary radial cracks.

The log joiner 30 of this invention comprises a flat metal plate 32 which has two depending, spaced clusters 34 and 36 of sharp nail-like projections. The clusters 34 and 36 are positioned near the ends of the plate 32 and between them is a depending bar 38 which is snugly received in the top slot 26 of a log 12*c*. Hence, the slot 38 may be placed and the nails 34 and 36 depending from plate 32, are driven down into the planar upper surface 18 of the log to form a firm anchor for receiving the next succeeding log 12*c*.

In fact, in the case of logs being joined end to end and customarily glued together in finger joints, angle joints or the like, the depending bar 38 may be inserted to extend into the top slots 26 of both end to end logs 12*c* and 12*d* so that when the plate 32 is driven downward the clusters of nails 34 and 36 firmly tie the end to end logs 12*c* and 12*d* together against longitudinal separation.

Extending upward from the plate 32 are vertical bars 40 and 42 between which is disposed a third, upwardly extending cluster of nails 44. Hence, the next log 12*c* may be easily positioned by dropping the lower slot 28 over the bars 40 and 42 and then forcing the log 12*e* downward so that the nails 44 penetrate into its planar lower surface 20. This now locks the upper log 12*e* against longitudinal or shear movement relative to the logs 12*c* and 12*d*.

Figure 3:
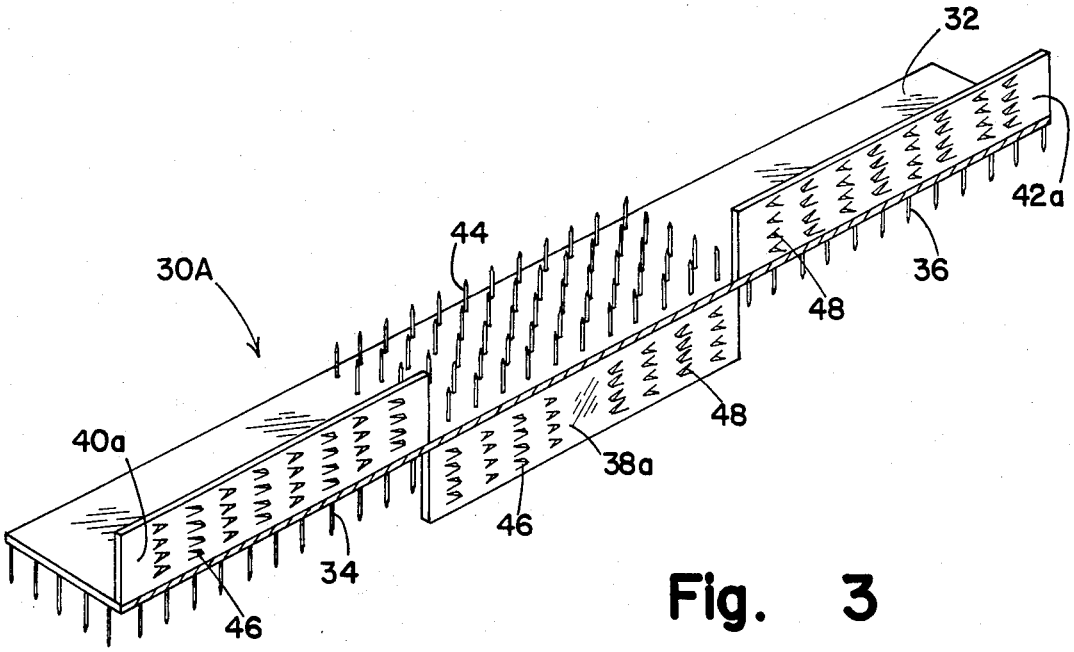
FIG. 3 is a section view in perspective showing another embodiment of the log joiner.

The Embodiment of FIG. 3

In this embodiment, the log joiner 30A has a similar plate 32 with depending clusters of nails 34 and 36 with an intermediate depending bar 38*a*. Also, extending upward from the plate 32 are spaced vertical bars 40*a* and 42*a* with an intermediate upwardly-extending cluster of nails 44.

However, in this embodiment, there is punched from the vertical bars 38*a*, 40*a* and 42*a* a plurality of sharp projections, or teeth 46 and 48, the projections 46 pointing to the right in FIG. 3 and the projections 48 pointing to the left. Rightward facing projections 46 are formed in the left vertical bar 40*a* and to the left of center in the bar 38*a* while the leftward projections 48 are formed in the right bar 42*a* and to the right of center of the bar 38*a*. Hence, when the plate is driven into two end to end logs, as for example logs 12*c* and 12*d* the oppositely directed projections 46 and 48 further lock the logs 12*c* and 12*d*, against separation and, when the next log 12*e* is placed the projections 46 and 48 likewise grip the wood in the sides of the slots 28 to augment the gripping.

Figure 4:
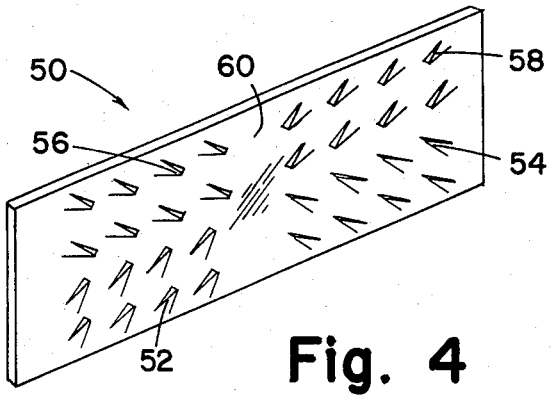
FIG. 4 is a partial, enlarged view of still another embodiment of this invention.
Figure 5:
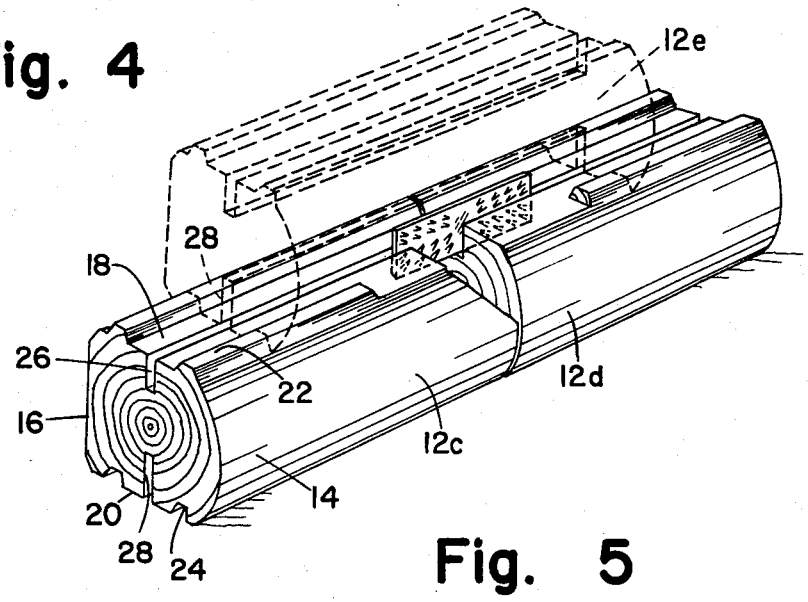
FIG. 5 is a partial view in perspective showing an adjacent pair of logs joined by the embodiment of FIG. 4.

The Embodiment of FIGS. 4 and 5

In this embodiment, a single bar 50 of steel or the like is provided with similar saw-toothed projections 52, 54, 56 and 58 punched to protrude from one surface 60 thereof. The saw teeth 52 and 54 are disposed at approximately 45° angles to point upward and toward each other. Hence, when the plate 50 is driven into the upper slot 26 the teeth 52 and 54 will flex inward to enable the bar to be driven in but will grip into the wood sides of the slot and resist removal and at the same time will grip against separation of the logs 12*c* and 12*d*. The upper teeth 56 and 58 are directed downward and inward, and will similarly be flexed inward as the log 12*d*, 12*e* is driven down over it with the bar received in the lower slot 28. Similarly, the teeth 56 and 58 will tend to flex outward to grip the wood and provide a firm anchor against vertical separation as well as longitudinal shear of the log 12*e* with respect to the logs 12*c* and 12*d*.

While this invention has been described in conjunction with preferred embodiments thereof, it is obvious that modifications and changes therein may be made by those skilled in the art to which it pertains without departing from the spirit and scope of this invention, as defined by the claims appended hereto.

What is claimed as invention is:

1. A building wall comprising:

a plurality of stacked logs;

each of said logs having a pair of side surfaces and generally planar top and bottom surfaces;

a slot cut into each of said planar surfaces to extend along the length thereof; and a log joiner securing vertically adjacent logs together comprising:

a metal plate;

a first cluster of pointed projections depending from said metal plate over a first area adjacent one end thereof penetrating a first lower log;

a second cluster of pointed projections extending upward from said metal plate over a second area displaced from said first area penetrating an upper log supported on said lower log;

a first vertical bar extending upward from said plate longitudinally across said first area received in the slot in the bottom of said upper log; and a second vertical bar depending from said plate longitudinally across said second area received in the slot in the top of said first lower log.

2. The building wall defined by claim 1 including:

a third cluster of pointed projections depending from said metal plate over a third area adjacent the other end thereof;

and a third vertical bar extending upward from said plate longitudinally across said third area received in the slot in the top of a lower log.

3. The building wall defined by claim 2 including:

a second lower log joined end to end with said first lower log;

said third cluster of pointed projections penetrating the upper surface of said second lower log.

4. The building wall defined by claim 3 wherein:

said second vertical bar is received in aligned slots in the tops of said first and second lower logs;

and including:

first and second arrays of toothed projections protruding from said second vertical bar on opposite sides of the joint between said first and second lower logs;

said first and second arrays being directed toward each other to engage the sides of said aligned slots and grip said first and second lower logs against separation thereof.

5. The building wall defined by claim 4 including:

third and fourth arrays of toothed projections protruding from said first and third vertical bars, respectively;

said third and fourth arrays being directed toward each other.

6. A building wall comprising:

a plurality of stacked logs;

including a pair of spliced logs joined end to end;

each of said logs having a pair of side surfaces and generally planar top and bottom surfaces;

a slot cut into each of said planar surfaces to extend along the length thereof; and a longitudinal shear resisting connector member securing vertically adjacent logs together comprising;

a metal bar received in longitudinally aligned slots of said spliced logs and the vertically aligned slot of an adjacent stacked log; and means forming a spaced pair of arrays of toothed projections in a side of said metal bar on opposite sides of the joint between said spliced logs;

said arrays being directed toward each other to engage the sides of said longitudinally and vertically aligned slots to grip said logs against longitudinal shear.

7. The building wall defined by claim 6 wherein:

there are two spaced pairs of arrays of toothed projections on said metal bar, one spaced pair being received in longitudinally aligned slots of spliced logs to grip the sides of same and the other spaced pair being received in the vertically aligned slot of said adjacent stacked log to grip the sides thereof.

8. A shear resisting log joiner for a building wall of a plurality of stacked logs having planar top and bottom surfaces with slots cut therein to extend along the length thereof; said connector member comprising:

a metal bar received in longitudinally aligned slots of logs spliced end to end, and the vertically aligned slot of an adjacent stacked log; and means forming two spaced pairs of arrays of toothed projections in a side of said metal bar on opposite sides of the joint between said spliced logs;

said arrays being directed toward each other to engage the sides of said longitudinally and vertically aligned slots to grip said logs against longitudinal shear; one spaced pair being received in longitudinally aligned slots of spliced logs to grip the sides of same and the other spaced pair being received in the vertically aligned slot of said adjacent stacked log to grip the sides thereof.

* * * * *